US010583973B1

(12) United States Patent
Wang et al.

(10) Patent No.: US 10,583,973 B1
(45) Date of Patent: Mar. 10, 2020

(54) COMBINATION CARRYING DEVICE

(71) Applicant: Amazon Technologies, Inc., Seattle, WA (US)

(72) Inventors: Xiao Wang, Seattle, WA (US); Aaron Benjamin Nather, Kirkland, WA (US); Jason Michael Famularo, Seattle, WA (US); Matthew James Bird, Seattle, WA (US); Thomas Duester, Seattle, WA (US)

(73) Assignee: Amazon Technologies, Inc., Seattle, WA (US)

( * ) Notice: Subject to any disclaimer, the term of this patent is extended or adjusted under 35 U.S.C. 154(b) by 17 days.

(21) Appl. No.: 14/583,552

(22) Filed: Dec. 26, 2014

(51) Int. Cl.
*B65D 77/04* (2006.01)

(52) U.S. Cl.
CPC ..... *B65D 77/04* (2013.01)

(58) Field of Classification Search
CPC .. B65D 77/04; B65D 77/042; B65D 77/0446; B65D 81/3825
USPC ..... 220/495, 495.06; 206/515, 516, 514
See application file for complete search history.

(56) References Cited

U.S. PATENT DOCUMENTS 3,032,230 A * 5/1962 Gerber ..... A45C 5/045 217/125
3,423,004 A * 1/1969 Christensson ..... B65D 5/64 229/117.27
D259,819 S 7/1981 Cornou
4,642,934 A 2/1987 Carlson et al.
5,337,910 A 8/1994 Picozza et al.
5,469,986 A 11/1995 Jang
5,938,035 A * 8/1999 Oglesby ..... B60R 7/02 206/576
7,163,120 B1 1/2007 Blucher
7,318,247 B2 * 1/2008 Libman ..... A47L 13/58 15/260
7,320,411 B1 1/2008 Shenosky et al.
7,669,713 B2 3/2010 Stahl
9,473,747 B2 10/2016 Kobres et al.
2003/0017930 A1 1/2003 Aizawa
2004/0016784 A1 * 1/2004 Berry ..... A45F 5/00 224/584
2007/0160783 A1 7/2007 Rieser et al.
2008/0128429 A1 6/2008 Towery et al.
2009/0080808 A1 3/2009 Hagen
(Continued)

FOREIGN PATENT DOCUMENTS

JP 3124104 U 8/2006

*Primary Examiner* — Jeffrey R Allen
(74) *Attorney, Agent, or Firm* — Athorus, PLLC

(57) ABSTRACT

A combination carrying device includes a rigid basket having a flexible bag nested therein. The flexible bag may be formed from one or more fabrics or like materials and define a tapered volume having a pair of handle extensions. The rigid basket may be formed from plastics or like materials and include rotatable handles disposed on an upper perimeter thereof, and may also define a tapered volume which corresponds to the tapered volume of the flexible bags. A customer carrying a combination carrying device in a materials handling facility (e.g., a warehouse or retail establishment) may place one or more items in the flexible bag nested within the rigid basket, and extract the flexible bag from the rigid basket upon arriving at a destination or after executing a purchase for the items therein.

23 Claims, 10 Drawing Sheets

(56) References Cited

U.S. PATENT DOCUMENTS

| | | | | |
|---|---|---|---|---|
| 2009/0180715 | A1 | 7/2009 | Wittke-Kothe | |
| 2013/0277265 | A1 * | 10/2013 | Varbanov | B65D 31/10<br>206/514 |

* cited by examiner

COMBINATION CARRYING DEVICE

BACKGROUND

Materials handling facilities such as warehouses or retail stores often provide durable item carriers to users, who may utilize the item carriers when transporting items throughout the facilities. For example, such facilities commonly provide users with carts, e.g., large vessels formed from metal or plastic that are configured to travel on wheels, as well as baskets or totes having substantially smaller vessels that may be carried by users with one or more handles.

If a user identifies one or more items that he or she intends to retrieve from a shelf or other location within a materials handling facility, the user may remove the items, place the items into an item carrier, and transport the items in the item carrier to an intended destination such as a distribution station or cash register, where the user may transfer the items from the item carrier to another facility at the destination or otherwise transition the items to another human operator or automated agent. When the user transfers the items at the intended destination, or transitions the items to the human operator or the automated agent, the user or the human operator must manually remove the items from the item carrier, and then relinquish control over the item carrier back to the materials handling facility. If such items feature an awkward or unmanageable shape, or lack a handle, the items may be removed from the item carrier and placed inside a plastic or fabric bag, or like container, to aid in the transfer or transition thereof.

Although durable item carriers such as baskets, totes or carts are effective and useful in enabling users to transport items throughout a materials handling facility, the processes by which users may purchase or otherwise check out such items are presently plagued by physical limitations and delays, in that the items must be removed from the item carrier before being placed in a bag or like container that may be released to the user. Such actions, whether performed by a staff member or a user, necessarily slow the rate at which the user may complete a transaction for the items, or otherwise take control of such items. Moreover, many bags in which such items may be placed are flimsy and formed from materials having relatively low shear strengths or yield stresses, such as paper or plastic.

DETAILED DESCRIPTION

As is set forth in greater detail below, the present disclosure is directed to combination carrying devices that may be utilized by users in materials handling facilities or like environments. More specifically, the systems and methods disclosed herein include totes or other carrying devices including baskets having rigid structural frames and bags provided within such frames, with a shape and storage capacity corresponding to the frames of the baskets. The carrying devices may be configured such that the bags are folded and held into place or nested within the baskets, which may feature retractable handles mounted along an outer rim of an upper perimeter, thereby enabling the carrying devices to be stacked. The bags may include side panels and end panels, with the side panels having longer dimensions and/or larger areas than the end panels, as well as folded handles that are disposed within an inner rim of the upper perimeter. Users may use the combination carrying devices to transport items within a materials handling facility and, upon completing a picking of items from inventory locations within the materials handling facility, lift the bag by the handles, thereby removing the bag and the items therein from the basket, and carry the bag, and the items, to an intended destination. For example, if the user has retrieved items from one or more inventory locations, and the items are to be transitioned to a packing station or conveyor, the user may lift the bag by the handles, thereby removing the bag and the items from the basket collectively, and transition the bag and the items to a packing station or onto a conveyor as a single unit, rather than removing each item from the basket and transitioning the items to the packing station or onto the conveyor individually.

As used herein, a "materials handling facility" may include, but is not limited to, warehouses, distribution centers, cross-docking facilities, order fulfillment facilities, packaging facilities, shipping facilities, rental facilities, libraries, retail stores or establishments, wholesale stores, museums, or other facilities or combinations of facilities for performing one or more functions of material or inventory handling for any purpose.

Figure 1B:
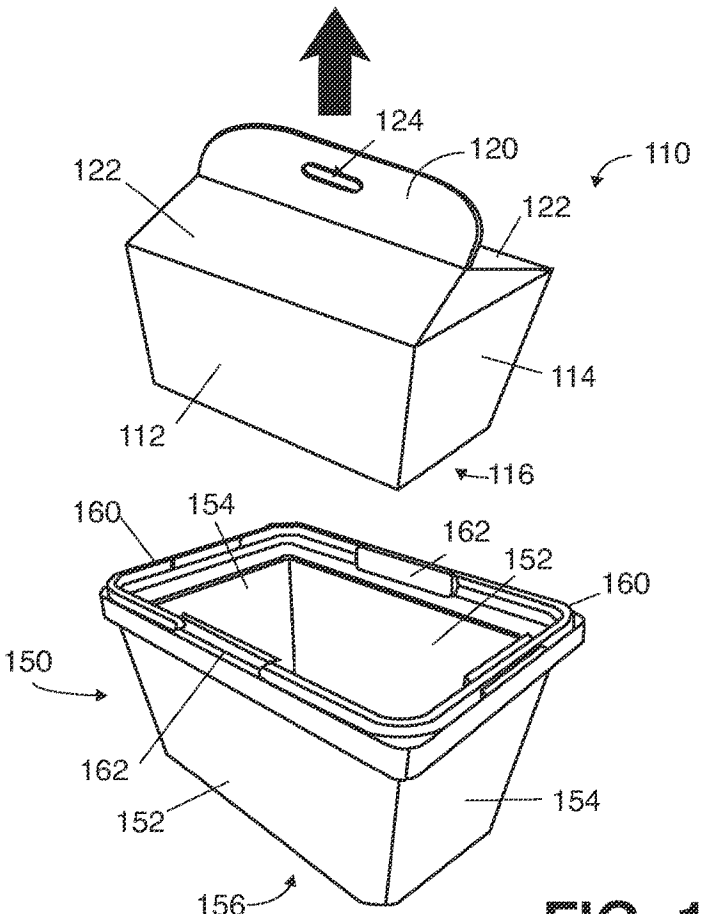
FIGS. 1A and 1B are views of components of one combination carrying device in accordance with implementations of the present disclosure.
Figure 1A:
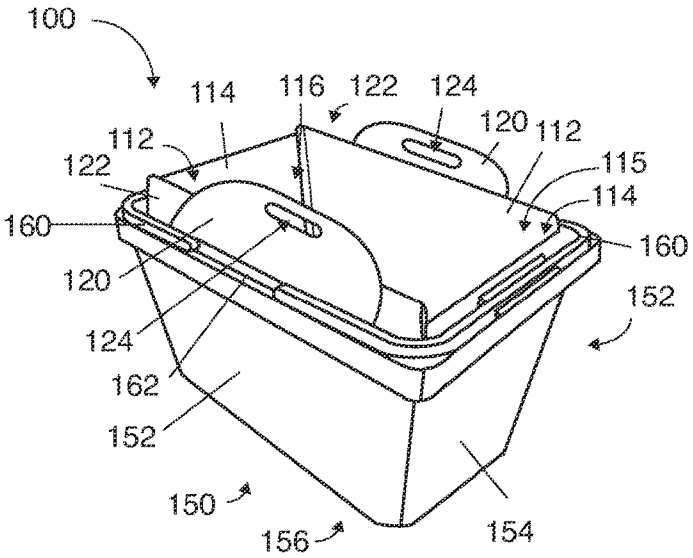

Referring to FIGS. 1A and 1B, a combination carrying device 100 including a bag 110 and a basket 150 is shown. The bag 110 includes a pair of long sides (or side panels) 112, a pair of short sides (or end panels) 114 and a bottom 116. The long sides 112 and the short sides 114 have substantially trapezoidal shapes, and the bottom 116 has a substantially rectangular shape. As is shown in FIGS. 1A and 1B, the long sides 112 have upper edges and lower edges having lengths that are comparatively greater than lengths of corresponding upper edges and lower edges of the short sides 114, and areas that are comparatively larger than areas of the short sides 114.

The long sides 112, the short sides 114 and the bottom 116 define a tapered or frustopyramidal hollow volume 115, e.g., a hollow cavity having a shape corresponding to a frustrum of a pyramid, or a pyramidal frustrum, for receiving one or more items therein. The volume 115 has a substantially rectangular horizontal cross-section with areas of descending size, from top to bottom, beginning with an area defined by upper edges of the long sides 112 and the short sides 114, and concluding with an area of the bottom 116. Additionally, the bag 110 further includes a pair of handles 120. Each of the pair of handles 120 comprises a handle panel or handle extension joined to one of the long sides 112 by a flap 122 that is formed integrally therewith, and further includes a slot 124 for accommodating one or more hands of a user (not shown).

Like the bag 110, the basket 150 includes a pair of long sides 152, a pair of short sides 154 and a bottom 156 which also define a tapered or frustopyramidal hollow volume 155 for receiving the bag 110 and the contents thereof within. The long sides 152 and the short sides 154 have substantially trapezoidal shapes, and the bottom 156 has a substantially rectangular shape. Additionally, and also like the bag 110, the volume 155 has a substantially rectangular horizontal cross-section with areas of descending size, from top to bottom, beginning with an area defined by upper edges of the long sides 152 and the short sides 154, and concluding with an area of the bottom 156.

As is shown in FIG. 1A, the bag 110 and the basket 150 have corresponding tapered or frustopyramidal shapes. For example, the various internal and external angles of the bag 110, e.g., the angles formed by the joining of the planar sections of the long sides 112, the short sides 114, and the bottom 116 of the bag 110, are substantially equal to the angles formed by the joining of the planar sections of the long sides 152, the short sides 154 and the bottom 156 of the basket 150. Accordingly, as is shown in FIG. 1A, the bag 110 may be nested within the basket 150 in a manner that causes the bag 110 to remain in place, such as by creasing portions of the handles 120 along the long sides 112 of the bag 110, and inserting the creased portions of the handles 120 between the long sides 112 of the bag 110 and the long sides 152 of the basket 150, thereby providing at least a nominal force of friction to resist either an unintended removal of the bag 110 from the basket 150, or an undesired collapse of the bag 110 into the basket 150, during normal use of the combination carrying device 100.

As is shown in FIG. 1B, when a user desires to remove the bag 110 and any items therein from the basket 150, the user may place one or more hands within the slots 124, and lift each of the handles 120, thereby extracting the bag 110 from the basket 150, while maintaining much of the structural integrity of the volume 115 of the bag 110.

Accordingly, the combination carrying devices of the present disclosure, including but not limited to the combination carrying device 100 of FIGS. 1A and 1B, may include bags or other like soft, flexible item carriers and baskets or other like firm, rigid item carriers, with the bags having external shapes and dimensions that are specifically selected to conform to interior shapes and dimensions of the baskets, such that the bags may be received within the baskets and maintained in place there. For example, the bags may be formed in tapered shapes having internal angles and external angles or other features that are substantially equal to their counterpart internal angles and external angles or other features of baskets, and include one or more dimensions that are slightly smaller than their counterpart dimensions of baskets, such that the bags may be simply and releasably nested within such baskets. The combination carrying devices thereby effectively join two carriers that are traditionally recognized as separate components, namely, a basket and a bag, in a manner that allows a user to seamlessly transition between exploiting the advantages of a basket, e.g., the strength and durability thereof, and the advantages of a bag, e.g., its portability and lightweight structure. The combination carrying devices further enable users to eliminate the requirement to transition picked items from a carrier or cart into a bag (e.g., when transitioning from picking to packing, or at a checkout station of a retail establishment), when the items to be transitioned are located in a basket, as the items are already placed within a volume of a bag that is releasably provided within a volume of the basket.

In accordance with the present disclosure, bags may be formed from flexible materials that define a cavity for receiving one or more objects therein, and may include handles extending from flaps provided along at least one side of the bags which enable the bags to be removed from the baskets, with the objects therein, when the items are to be transitioned from one state to another. According to some implementations, the handles may constitute substantially planar elements defined by chords, bases or segments which are connected to one or more flaps extending along opposing lengths of the bags. According to some other implementations, the bags may include pairs of straps or strap-like handles corresponding to different uses thereof. For example, a bag may include a pair of handles on opposing sides thereof, including a pair of long handles for carrying the bag about a shoulder or forearm, and a pair of short handles for carrying the bag by hand or for removing the bag from a basket in which the bag is nested. The handles of the present disclosure may include reinforcement stitching in selected locations thereof, including about all or a portion of a perimeter of an opening for a hand, arm or shoulder, or along all or a portion of a length of a strap.

Using one or more of the carrying devices disclosed herein, items may be transitioned from picking to packing, or from picking to a conveyor, at the conclusion of a working or shopping experience, or at another appropriate time. The baskets may be formed from one or more durable materials, and may be configured to receive and maintain the bags in place therein. Additionally, the baskets may be provided with two or more handles mounted along and outside of an upper perimeter, such that the handles do not interfere with the insertion or removal of the bags, and enable the baskets to be stored in a stack or other like arrangement, with bags interleaved therein.

For example, the bags may be formed from any type or form of flexible materials, e.g., one or more panels of such materials, including but not limited to knitted, woven or non-woven fabrics, natural or synthetic leathers or canvases, or other like materials that may be joined at one or more edges thereof, such as by stitching. Preferably, the materials from which the bags are formed are sufficiently structurally sound such that the bags remain erect even after the bags have been removed from their respective baskets, and are yet flexible enough to be folded and deposited within the baskets in a manner that causes the bags to be held in place therein. Additionally, the bags are preferably formed with rectangular cross sections and in tapered, frustopyramidal shapes that conform to interior volumes of the baskets in which the bags are placed.

In some implementations, the bags may be formed from one or more panels of fibrous fabrics that are formed at least in part from paper, cotton or recycled plastics, including but not limited to fabrics comprising blends of cotton or like materials and materials comprising recycled plastics, thereby providing the bags with enhanced hydrophobicity to repel liquids or other stain-forming matter. For example, in some implementations, the bags may be formed from non-woven plastic polypropylene materials, while in other implementations, the bags may be formed from woven fabrics including polypropylene or polyethylene fibers. Moreover, the bags may be formed from materials that are laminated on one or both sides thereof, and such materials from which the bags are formed may be selected on any basis. Laminating or otherwise reinforcing or protecting such materials enables the bags to be used, washed and reused on several occasions. For example, where the bags disclosed herein are intended to be reused by customers who received them from a retail establishment, or by the retail establishment that furnished the bags to the customers, such materials may selected based on their durability and capacity to withstand repetitive cleaning and reuse in a variety of environments.

The bags may also include handles provided on long sides thereof, within polygonal shapes or flaps extending along all or a portion of the long sides of the bag. Such shapes or flaps ensure that tensile forces provided by a customer who is holding a bag from above, by the handles, are evenly distributed throughout the length of the bag, and not concentrated about one or more likely points of failure. The handles may include one or more slots defined by elongated holes that are aligned substantially parallel to the long sides of the bag. Such slots may be may be reinforced, as necessary, with perimeter stitching.

In accordance with the present disclosure, baskets may be formed in tapered, frustopyramidal shapes corresponding to such tapered, frustopyramidal shapes of the bags provided therein, and from plastic, wood, metal or other durable materials that provide structural support and orientation of bags and the contents thereof. For example, the baskets may be formed from one or more types of thermosetting plastics such as epoxy or phenolic resins, polyurethanes or polyesters, as well as polyethylenes, polypropylenes or polyvinyl chlorides. In some implementations, the baskets may be substantially solid, e.g., without holes or other perforations therein. In some other implementations, however, the baskets may be provided with slots or holes, in a regular or irregular lattice or other arrangement. Additionally, the baskets may include two or more handles that are provided on an upper perimeter and mounted to exterior surfaces thereof. According to some implementations, a pair of handles, each having lengths corresponding approximately to half of the upper perimeter may be mounted to central points about the upper perimeter with pivotable or rotatable connections, such that that ends of the handles may pivot or rotate about such points from a lowered position along the upper perimeter to a raised position where the ends may be joined above the baskets. Such handles may include one or more ergonomically designed features that are provided in order to enhance the comfort of a user who is transporting a combination carrying device using his or her hands or arms, such as perpendicular joints having rounded shapes.

The tapered, frustopyramidal shapes of the baskets, and the mounting of the handles along exterior surfaces thereof, enable combination carrying devices including such baskets to be stacked with or without bags provided therein. For example, two or more combination carrying devices having bags disposed in baskets may be stacked with the devices oriented upwardly, e.g., with openings of the volumes defined by such bags and baskets aligned in a vertically upward manner, such as is shown in the combination carrying device 100 of FIG. 1A, near an entrance to a materials handling facility. Users may retrieve one of the combination carrying devices upon arriving at the materials handling facility, and may travel throughout the materials handling facility to search for items of interest, and place one or more of such items within a bag provided within a basket. When the user has completed picking of the items, the user may remove the bag from the basket, and stack the basket near an exit of the materials handling facility, e.g., in a downward orientation, with the openings of the volumes defined by the basket aligned in a vertically downward manner.

Additionally, the baskets may further include slits, clips or other features, or combinations of features, that are designed to correspond with one or more pockets, tabs or other features, or combinations of features, of bags and aligned to nest a bag in place therein. When a bag is nested within a basket, such features ensure that the bag may not be removed from the basket without further manual interaction that releases the edges from beneath such features. For example, according to some implementations, a bag may include a pocket or other open portion provided along one or more of the outer sides thereof, and a basket may include one or more hooks or other features provided along one or more of the inner sides thereof for receiving at least the pocket or another portion of the bag therein. The bag may be releasably nested within the basket when at least a portion of a pocket is received within a hook, e.g., between at least a portion of the hook and the inner surface on which the hook is provided.

Alternatively, according to some other implementations, a bag may include one or more stitched tabs or extensions provided along an outer surface thereof, e.g., at one or more corners defined by an intersection between two or more of the panels thereof. The stitched tabs or extensions may include narrow sections for joining the tabs or extensions to the outer surface of the bag, and broader sections at distal ends thereof, with such broader sections formed by folds, turns or knots of fabric or other like material. The baskets may include slots provided along inner surfaces thereof, e.g., at one or more corners defined by an intersection between two or more of the panels thereof, with such slots sized to accommodate at least a portion of the tabs or extensions therein.

In this regard, such features may ensure that when a plurality of the combination carrying devices are provided in a stack, a pocket of the bag may be provided within a hook of the basket, or a tab of the bag may be slid into a slot of the basket, thereby causing the bag to remain nested within the basket when a customer retrieves one of the combination carrying devices from the stack. When the bag is releasably nested within the basket, e.g., by way of a hook-and-pocket combination, or a tab-and-slot combination, the bag will not remain attached to a basket provided beneath the combination carrying device in the stack. Such features thereby maintain the bag releasably nested within the basket, and also ensure that the bag does not collapse within the basket.

Moreover, the baskets may also include clips or similar features which lock the baskets together when such baskets are stacked without bags nested therein, yet do not lock the baskets together when such baskets are stacked with bags nested therein. Such clips or other features permit baskets that are nested with bags to be stacked in an unlocked or removable configuration, while locking baskets that do not include bags in a fixed configuration. Thus, baskets that are nested with bags may be placed alongside baskets which lack bags near an entrance or an exit to a materials handling facility in separate stacks, enabling users to retrieve baskets that are nested with bags from one of the stacks, but preventing users from retrieving baskets which lack bags from the other of the stacks.

Additional features and advantages of the combination carrying devices, and the bags or baskets associated therewith, are set forth in greater detail below.

Figure 2B:
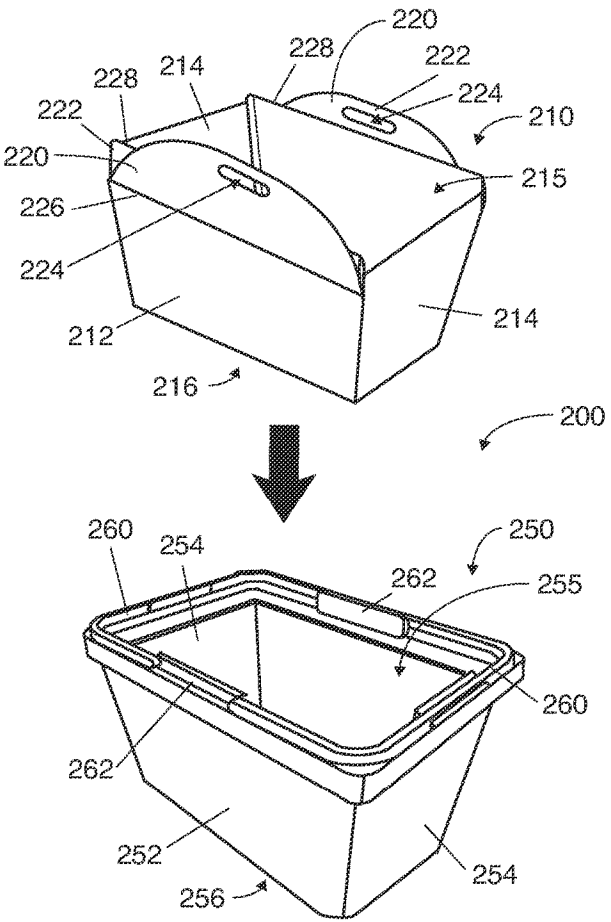
FIGS. 2A and 2B are views of one bag provided for use in a combination carrying device in accordance with implementations of the present disclosure.
Figure 2A:
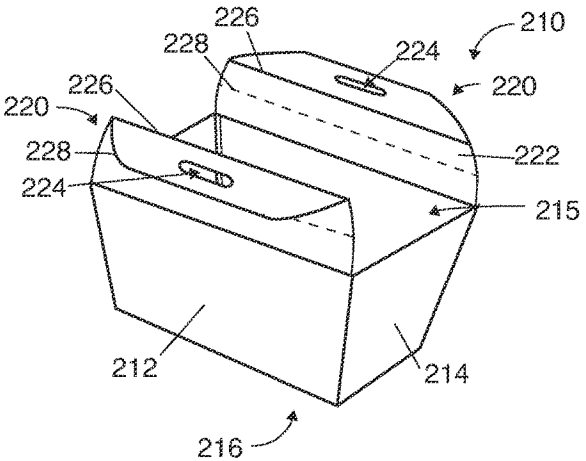

Referring to FIGS. 2A and 2B, one example of a bag 210 that may be provided for use in one or more combination carrying devices of the present disclosure is shown. Except where otherwise noted, reference numerals preceded by the number "2" shown in FIG. 2A or 2B indicate components or features that are similar to components or features having reference numerals preceded by the number "1" shown in FIGS. 1A and 1B.

As is shown in FIG. 2A, the bag 210 includes a pair of long sides 212, a pair of short sides 214 and a bottom 216. The long sides 212 and the short sides 214 extend vertically upward from the bottom 216, and define a tapered volume 215. Additionally, the bag 210 further includes a pair of handles 220, with each handle 220 being joined to an upper edge of one of the long sides 212 by a flap 222. Each of the handles 220 further includes a slot 224 having a size and orientation for accommodating a hand therein. Each of the handles 220 is shown as having a crease 226 at which the handle 220 is flexibly folded or bent, as well as a scored line 228 that may accommodate one or more creases when the bag 210 is folded for insertion into a corresponding basket.

Referring to FIG. 2B, a combination carrying device 200 including the bag 210 of FIG. 2A and a basket 250 is shown. Each of the handles 220 of the bag 210 is twice folded such that the bag 210 may be releasably nested within a volume 255 of the basket 250. For example, the handles 220 are folded twice, including first about the crease 226 and second along the scored line 228. In the folded configuration shown in FIG. 2B, the bag 210 may be inserted into the volume 255 of the basket 250, and the combination carrying device 200, including both the bag 210 and the basket 250, may be provided to a user at a materials handling facility. The user may place one or more items within the volume 215 of the bag 210 and, after completing a transaction for the purchase of the items, lift the bag 210 from the basket 250 by placing his or her hands within the slots 224 and raising the bag 210 and the items therein by the handles 220, such as is shown with regard to the bag 110 of FIG. 1B.

Those of ordinary skill in the pertinent arts will recognize that the bags provided in the combination carrying devices of the present disclosure may be formed from any number of panels of appropriate fabric-based materials, including one or more knitted, woven or non-woven fabrics, as well as natural or synthetic leathers, canvases or other like materials. Such materials may be stitched together at appropriate locations to form one or more seams. As is discussed above, the bags may include handles formed from one or more polygonal or rounded shapes, rather than in a substantially linear fashion, thereby enhancing the strength of the handles at one or more anticipated failure points along slot perimeters, and distributing forces associated with lifting and carrying such bags along one or more lengths thereof. Additionally, reinforcement stitches may be provided, where necessary, to enhance the durability and survivability of such bags during and after use thereof.

Figure 3B:
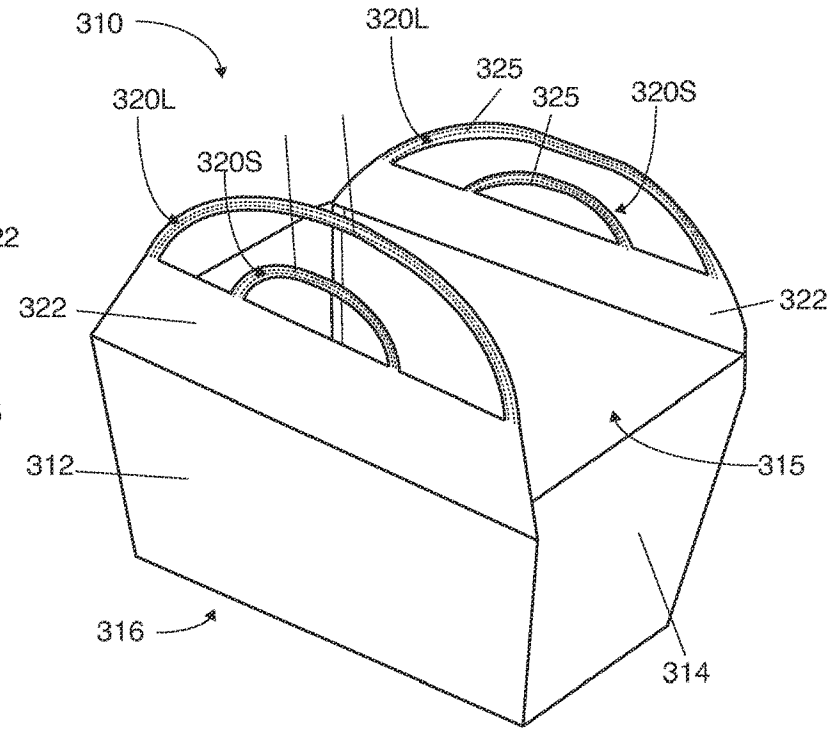
FIGS. 3A and 3B are views of one bag provided for use in a combination carrying device in accordance with implementations of the present disclosure.
Figure 3A:
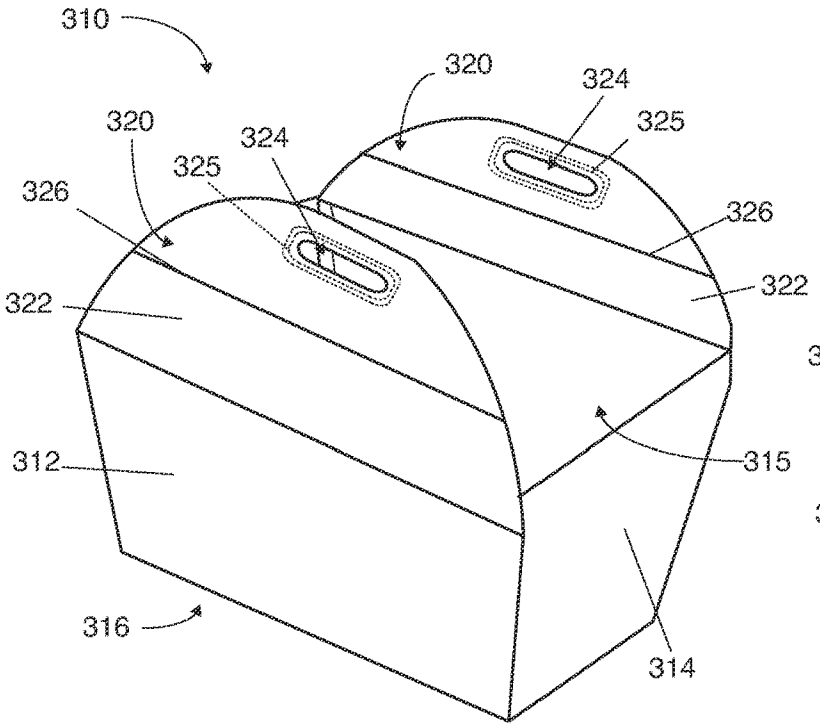

Referring to FIGS. 3A and 3B, implementations of bags 300 of the present disclosure are shown. Except where otherwise noted, reference numerals preceded by the number "3" shown in FIG. 3A or FIG. 3B indicate components or features that are similar to components or features having reference numerals preceded by the number "2" shown in FIG. 2A or 2B, or by the number "1" shown in FIGS. 1A and 1B.

As is shown in FIG. 3A, the bag 300 includes a pair of long sides 312, a pair of short sides 314 and a bottom 316 defining a volume 315. The long sides 312, the short sides 314 and/or the bottom 316 may be formed from a common material, or joined by stitching or any other manner at one or more seams. The bag 300 further includes a pair of handles 320 extend from flaps 322 that are joined at upper portions of the long sides 312. The handles 320 include slots 324 for accommodating one or more fingers of hands therein, as well as creases 326 for enabling the handles 320 to be folded easily when nesting the bag 310 within a basket (not shown). Additionally, as is shown in FIG. 3A, the slots 324 further include double reinforcement stitching stitches 325 along a perimeter thereof, to provide reinforcement against shear forces associated with the lifting and carrying of the bag 310. Those of ordinary skill in the pertinent arts will recognize that any type or form of reinforcement may be provided to the slots 324 of the handles 320, in addition to reinforcement stitching, or to any other portion or region of the handles 320, the flaps 322 or the slots 324.

As is further shown in FIG. 3A, the handles 320 are each formed in substantially hemispheric (e.g., semicircular) shapes, and extend from or are joined at a chord corresponding to an upper edge of each of the long sides 312. The hemispheric shapes of the handles 320 ensure that forces provided by users who grip the bag 310 at the slots 324 will be evenly distributed along the long sides 312 of the bag 310, and not concentrated immediately beneath the handles 320, about a midpoint thereof. Thus, the even distribution of such forces aids in maintaining the structural integrity of the bag 310 and the volume 315, and in preserving the orientation and/or alignment of any items provided therein.

Although the handles 320 of FIG. 3A are formed in substantially hemispheric shapes, those of ordinary skill in the pertinent arts will recognize that such handles may be formed of any substantially planar shape having an edge that may be joined to an upper edge of the one of the long sides 312. Some such shapes may include, but are not limited to, rectangles, triangles, trapezoids or the like. For example, handle extensions or handle panels of the present disclosure may be formed in the shape of a trapezoid having a base joined to an upper edge of a long side or side panel. Alternatively, the handle extensions or handle panels may be formed in the shapes of circular, elliptical or parabolic sectors defining arcs and chords or segments that are also joined to the upper edge of the long side or side panel.

As is discussed above, the bags of the present disclosure may include any number of handles of any type or form, including one or more planar handles, such as is shown in FIG. 3A, or one or more straps or strap-like handles. As is shown in FIG. 3B, the bag 300 includes a pair of long handles 320L and a pair of short handles 320S provided on the opposing long sides 312 thereof. As is shown in FIG. 3B, the pairs of long handles 320L and the pairs of short handles 320S are formed from straps provided in substantially equal lengths on the opposing long sides 312, and are reinforced by double reinforcement stitching 325. The pairs of long handles 320L or the pairs of short handles 320S may be formed from and integral to the same common material as the long sides 312, the short sides 314 or the bottom 316, or formed from different materials, or discrete pieces of materials, that are joined to one or more of the long sides 312 or the short side 314 in any manner, e.g., by stitching, staples or adhesives, or a combination of stitching, staples or adhesives.

The bags of the present disclosure, such as the bag 310 of FIG. 3B, may be provided with a variety of handles for different purposes. For example, the long handles 320L of the bag 310 of FIG. 3B may be provided to enable a user to carry the bag 310 using his or her shoulders or forearms, e.g., after the bag 310 and any items therein have been extracted from a basket, such as at the conclusion of any picking or shopping experience. The short handles 320S of the bag 310 of FIG. 3B, meanwhile, may be provided to enable a user to extract the bag 310 and any items therein from a basket, or to carry the bag 310 and any items herein using his or her hands.

Although the pairs of long handles 320L and the pairs of short handles 320S are substantially semicircular in shape, those of ordinary skill in the pertinent arts will recognize that straps or strap-like handles, such as the long handles 320L or the short handles 320S of FIG. 3B, may be provided in any shape, including continuous arcs such as portions of circles, parabolas or ellipses, as well as discontinuous shapes such as portions of squares, rectangles or triangles. Additionally, those of ordinary skill in the pertinent arts will recognize that straps or strap-like handles such as the long handles 320L or the short handles 320S may be folded in the same manner as the handles 320 of FIG. 3A, e.g., in order to enable the bag 310 of FIG. 3B to be releasably nested within a basket. Also, those of ordinary skill in the pertinent arts will further recognize that the bags of the present disclosure need not include handles of identical or similar shapes or sizes. For example, in some implementations, a bag may include one or more substantially planar handles, such as the handle 320 of the bag 310 of FIG. 3A, in combination with one or more straps or strap-like handles, such as the long handles 320L or the short handles 320S of the bag 310 of FIG. 3B.

Figure 4A:
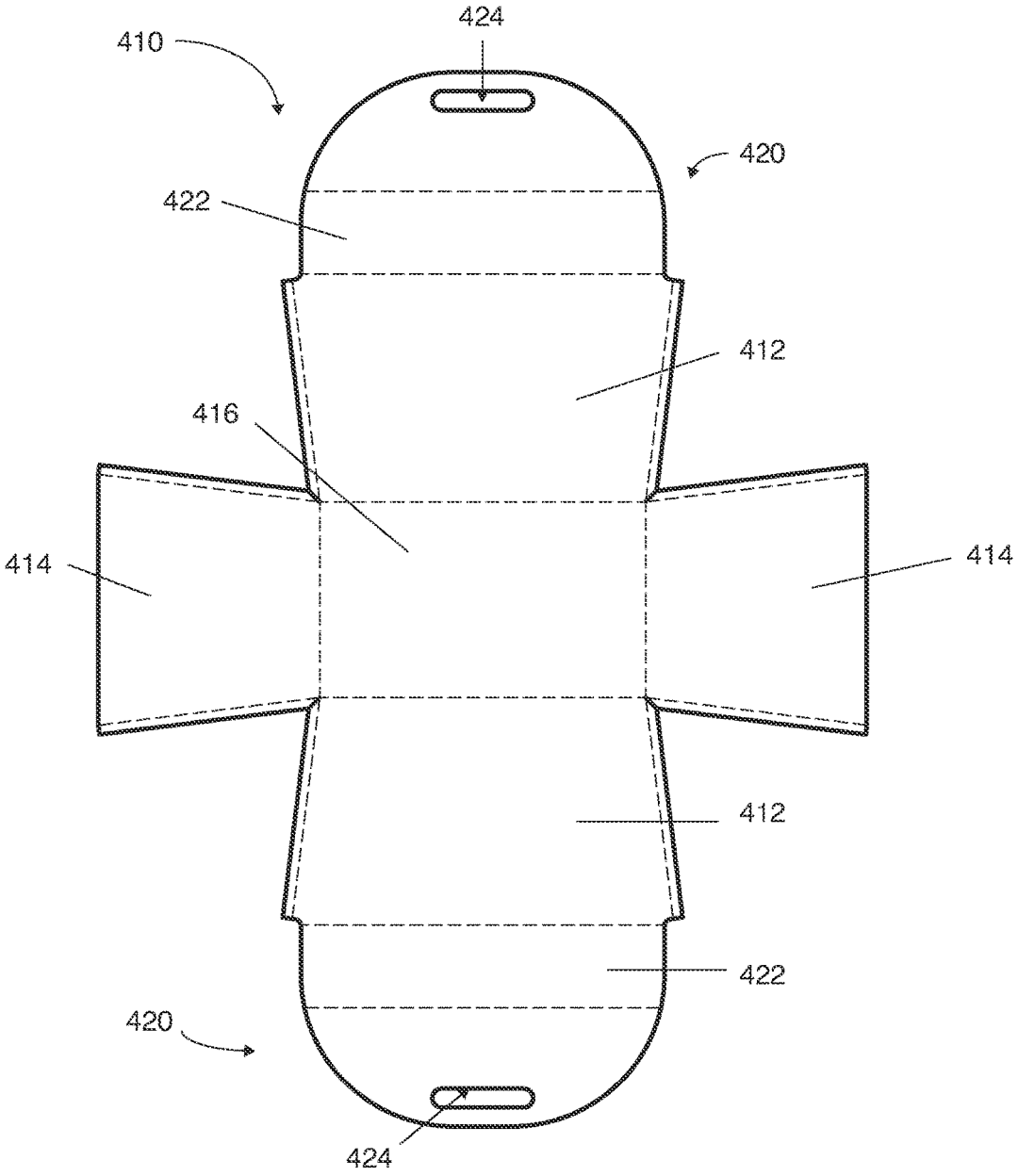
FIGS. 4A and 4B are views of one component of one bag provided for use in a combination carrying device in accordance with implementations of the present disclosure.
Figure 4B:
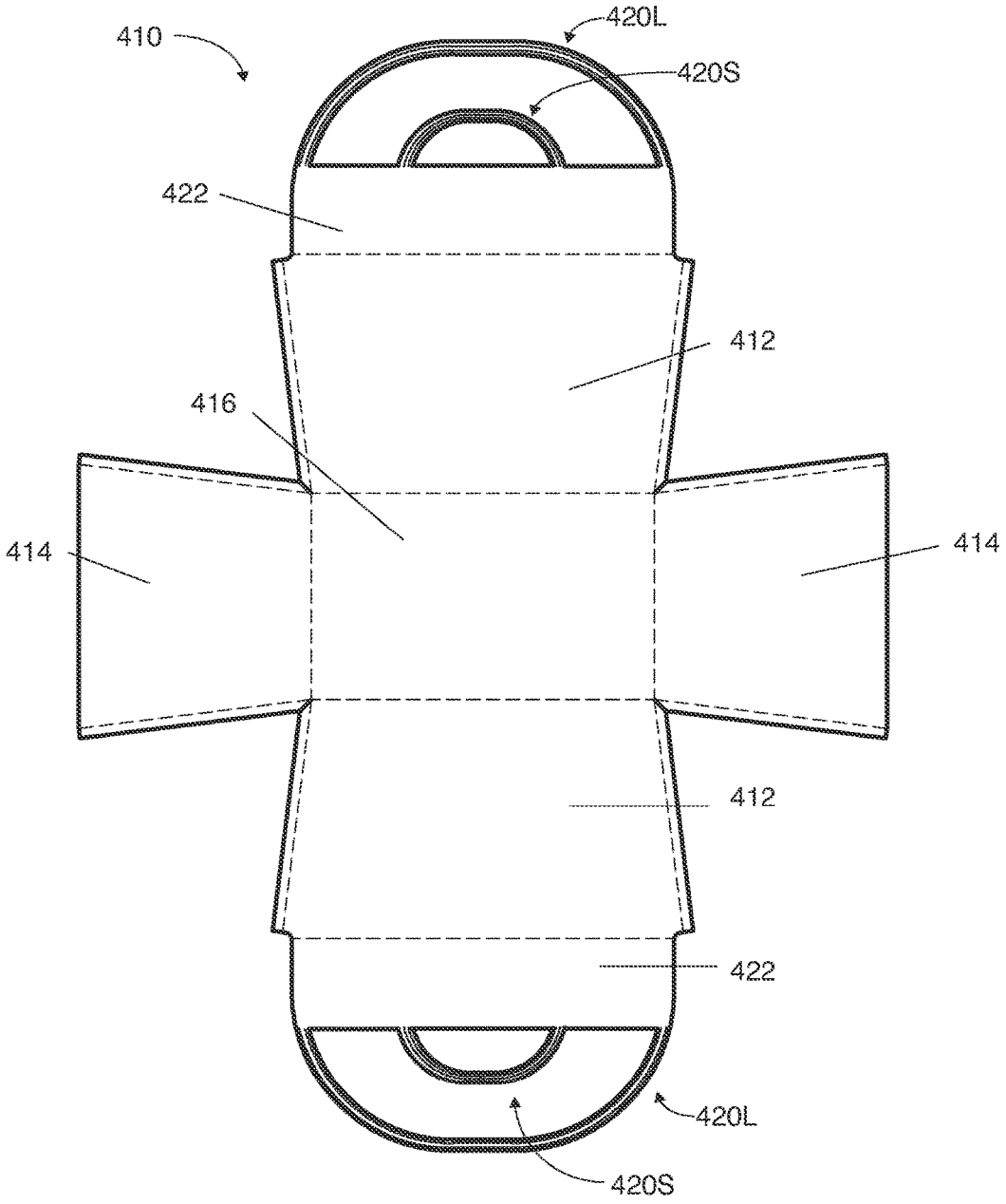

According to some implementations of the present disclosure, the bags may be formed in a single-piece construction from a piece of fabric that is properly cut and shaped, and may be subsequently stitched or joined in order to define a volume that corresponds to an interior of a basket and may be nested therein. Referring to FIGS. 4A and 4B, single pieces 410 of fabric are shown. Except where otherwise noted, reference numerals preceded by the number "4" shown in FIG. 4 indicate components or features that are similar to components or features having reference numerals preceded by the number "3" shown in FIG. 3, by the number "2" shown in FIG. 2A or 2B, or by the number "1" shown in FIGS. 1A and 1B.

As is shown in FIG. 4A, the single piece 410 of fabric corresponds to a bag such as the bag 310 of FIG. 3A. The single piece 410 of FIG. 4A includes each of the facets and features of the bag 310 of FIG. 3A and may be provided in one or more of the combination carrying devices disclosed herein. For example, the single piece 410 includes panels or subsections corresponding to sides and a bottom of such a bag, including subsections 412 corresponding to long sides of the bag, subsections 414 corresponding to short sides of the bag and a subsection 416 corresponding to a bottom of the bag. When the subsections 414, 416 are joined together at their respective sides, e.g., by stitching, gluing, bonding or the like, using one or more adhesives, the single piece 410 of fabric will define a volume, such as the volume 115 of the bag 110 of FIG. 1A, that may be nested within a basket, such as the basket 150 of FIG. 1A, and accommodate one or more items therein.

Additionally, as is also shown in FIG. 4A, the single piece 410 of fabric also includes a pair of substantially semicircular planar subsections 420 corresponding to handles which include flaps 422 and are joined to the subsections 412 corresponding to long sides. The subsections 420 further include slots 424 provided near an outer perimeter of the subsections 420, which may be used as handles when a bag is formed from the single piece 410 of fabric.

As is shown in FIG. 4B, the single piece 410 of fabric corresponds to a bag, such as the bag 310 of FIG. 3B. Like the single piece 410 of fabric of FIG. 4A, the single piece 410 of fabric of FIG. 4B includes each of the facets and features of the bag 310 of FIG. 3B and may be provided in one or more of the combination carrying devices disclosed herein. Like those of the single piece 410 of FIG. 4A, the panels or subsections 412, 414, 416 of the single piece 410 of FIG. 4B may be joined at their respective sides to define a volume, such as the volume 115 of FIG. 1A, that may be nested within a basket, such as the basket 150 of FIG. 1A, and accommodate one or more items therein.

Additionally, as is also shown in FIG. 4B, the single piece 410 of fabric also includes a pair of substantially semicircular straps or strap-like long subsections 420L and a pair of substantially semicircular straps or strap-like short subsections 420S which include flaps 422 and are joined to the subsections 412 corresponding to the long sides. In accordance with the present disclosure, the single pieces 410 of fabric from which bags may be formed may include straps or strap-like handles of any length, shape or thickness, and need not be limited to the lengths, shapes or thicknesses of the long subsections 420L or the short subsections 420S shown in FIG. 4B.

Forming a bag from a single piece of fabric, such as the single pieces 410 of FIG. 4A or FIG. 4B, provides a number of advantages over prior art materials and methods. For example, referring again to FIG. 4A, a bag may be assembled by cutting the single piece 410 including subsections corresponding to the various facets or features of the bag from a larger piece of fabric, joining the subsections 412, 414 at four pairs of edges that are adjacent to one another, and defining the handles from the subsections 420. Next, the most critical boundaries of the bag, e.g., the edges between the respective long sides and short sides thereof, may be reinforced by stitching or other means, thereby enhancing the structural strength thereof.

Those of ordinary skill in the pertinent arts will recognize, however, that the bags of the present disclosure may be formed from any number of pieces of fabric or other sufficiently strong materials, and are not limited to construction from single pieces, such as the single pieces 410 of FIG. 4A or FIG. 4B.

As is discussed above, the combination carrying devices of the present disclosure include baskets formed from suitably durable materials which have shapes and volumes corresponding to a bag, such as one of the bags 110, 210, 310 of FIG. 1A, 1B, 2A, 2B or 3, and are configured to receive and nest one or more of such bags therein. Referring to FIGS. 5A, 5B, 5C and 5D, one implementation of a basket 550 in accordance with the present disclosure is shown. Except where otherwise noted, reference numerals preceded by the number "5" shown in FIG. 5A, FIG. 5B, FIG. 5C or FIG. 5D indicate components or features that are similar to components or features having reference numerals preceded by the number "2" shown in FIG. 2B, or by the number "1" shown in FIGS. 1A and 1B.

Figure 5B:
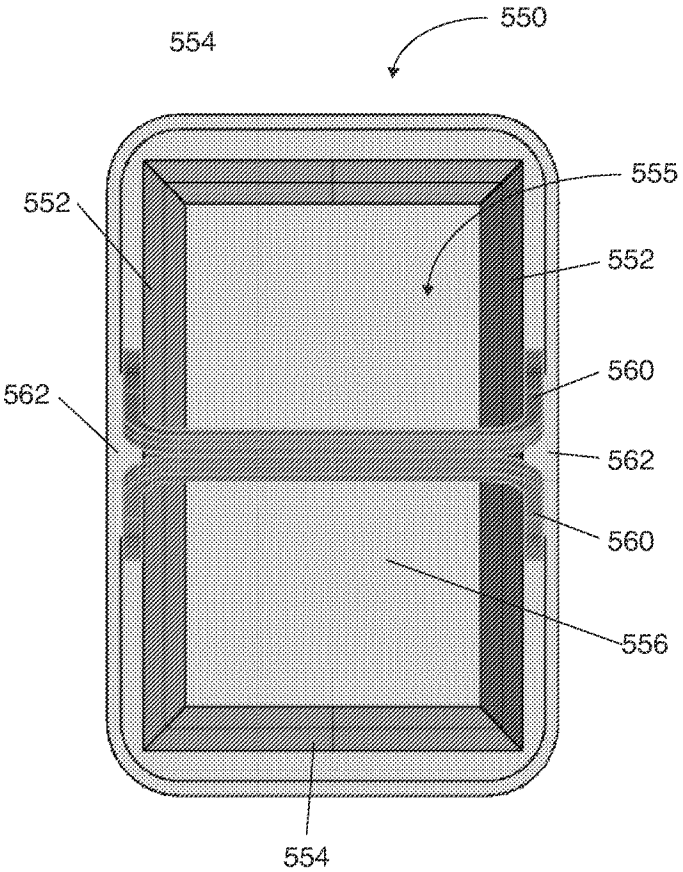
FIGS. 5A, 5B, 5C and 5D are views of one basket provided for use in a combination carrying device in accordance with the present disclosure.
Figure 5A:
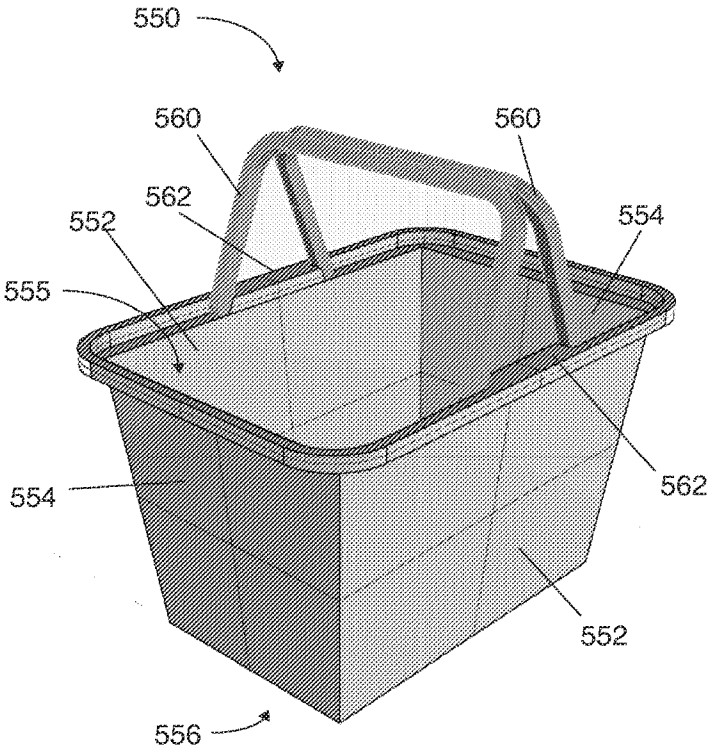

Referring to FIG. 5A, a perspective view of the basket 550 is shown. The basket 550 is formed from a pair of long sides 552, a pair of short sides 554 and a bottom 556 that are integrally joined as a single unit and define a tapered volume 555. The basket 550 further includes a pair of handles 560, each of which is rotatably mounted at a central mount 562 provided at an upper edge of one of the long sides 552 and along an upper perimeter of the volume 555. In sum, the lengths of the handles 560 and the central mounts 562 generally correspond to the length of the upper perimeter of the volume 555, such that when the handles are rotated outwardly and downwardly, the handles 560 will rest atop the upper perimeter and define a uniform surface above and about the volume 555. The long sides 552, the short sides 554 and the bottom 556 may be formed from a single piece of molded plastic. In other implementations, the basket 550 may be formed from multiple pieces of plastic or any other suitable material.

Moreover, although the long sides 552, the short sides 554 and the bottom 556 are shown in FIG. 5A as substantially solid, those of ordinary skill in the pertinent arts will further recognize that one or more of the long sides 552, the short sides 554 or the bottom 556 may be formed from materials having one or more holes, slots or other perforations which may still accommodate one or more bags (not shown) nested therein, and also provide sufficient structural support for such bags and any contents thereof. Additionally, although the volume 555 of the basket 550 of FIG. 5A is shown as having a substantially frustopyramidal shape, those of ordinary skill in the pertinent arts will also recognize that the combination carrying devices of the present disclosure may feature volumes of any shape, and may be configured to receive and nest bags having volumes which correspond to such shapes.

Figure 5D:
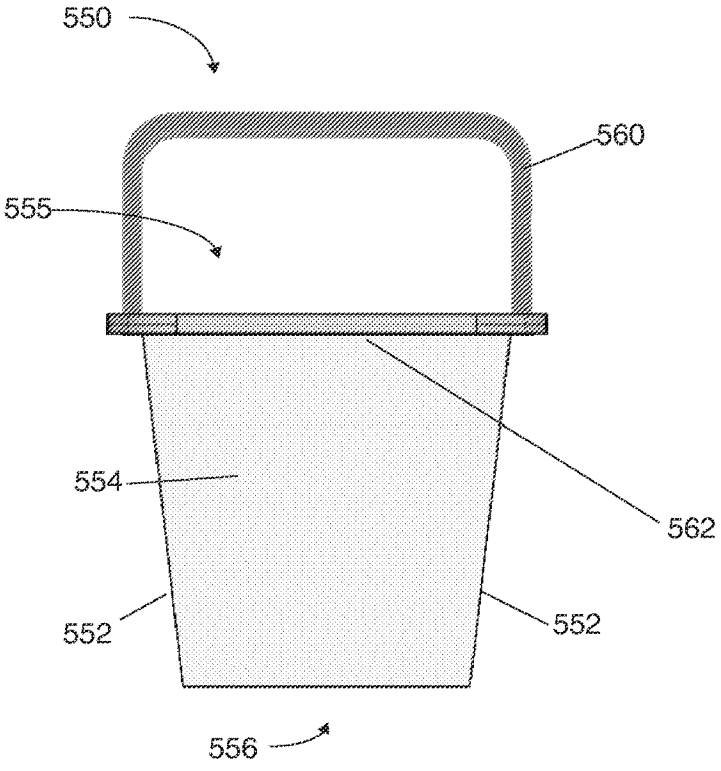
Figure 5C:
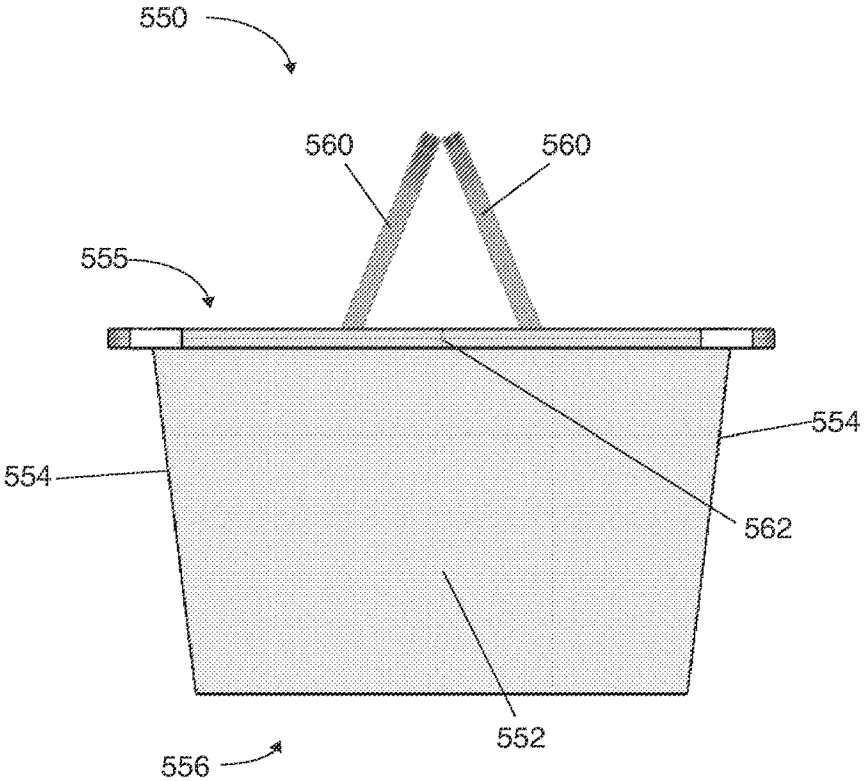

Referring to FIGS. 5B, 5C and 5D, a top view, a front view and a side view of the basket 550 of FIG. 5A, respectively, are shown. The top view of the basket 550 shown in FIG. 5B represents the shape and construction of the volume 555 of the basket 550, and reflects the tapered construction of the long sides 552, the short sides 554 and the bottom 556. Additionally, the top view of the basket 550 of FIG. 5B shows the shape of the upper perimeter of the basket 550 with respect to the shape of the handles 560 as shown in FIG. 5A. The front view and side view of the basket 550 of FIG. 5C and FIG. 5D shows the sizes of the long sides 552 and the short sides 554 with respect to one another. Additionally, the front view and side view of the basket 550 of FIG. 5C and FIG. 5D also show the angular orientation of the handles 560 when the handles 560 are raised atop the upper perimeter of the volume 555.

Furthermore, the perspective view and the side view of the basket 550 in FIGS. 5A and 5D also depict the shapes of the handles 560, which are shown as having substantially straight radial support members that are joined to the central mount 562, and substantially horizontal support members that may be gripped by users who are transporting basket 550, e.g., as part of a combination carrying device having a bag such as one of the bags 110, 210, 310 of FIG. 1A, 1B, 2A, 2B or 3 therein, using their respective hands, forearms, elbows or any other body parts. The handles 560 include intersections between the radial support members and the horizontal support members that are ergonomically shaped, e.g., rounded, and not squared or pointed, to avoid potentially injuring a user or one or more individuals, or damaging property, as a combination carrying device including the basket 550 is carried by the user.

As is discussed above, the baskets and bags disclosed herein may be formed of any size and may have any dimensions. For example, in one implementation, a basket may have a height of approximately ten to fifteen inches (10-15"), a length of approximately twelve to twenty-four inches (12-24") and a width of approximately nine to eighteen inches (9-18"), and may define tapered volumes for receiving and nesting a bag therein. Such baskets may further include rotatable handles having a maximum length of approximately six to nine inches (6-9"). The bags may have any heights, lengths, widths or volumes corresponding to the heights, lengths, widths or volumes of the baskets, and may be sized to be accommodated within such baskets.

As is discussed above, the handles of the baskets of the combination carrying devices disclosed herein may have lengths corresponding to the upper perimeter of volumes defined by such baskets, and may be rotatably mounted and aligned near a center of a long side of the baskets along the upper perimeter, such that the handles may be rotated upwardly and inwardly to enable the combination carrying devices to be carried by a user, or downwardly and outwardly to enable the bags to be removed from the baskets or to enable the baskets to be stacked. The rotatable mounting and alignment of the handles further may provide additional clearance for items that are substantially taller than either of the long sides or the short sides of the baskets to be carried within bags nested therein.

Figure 6B:
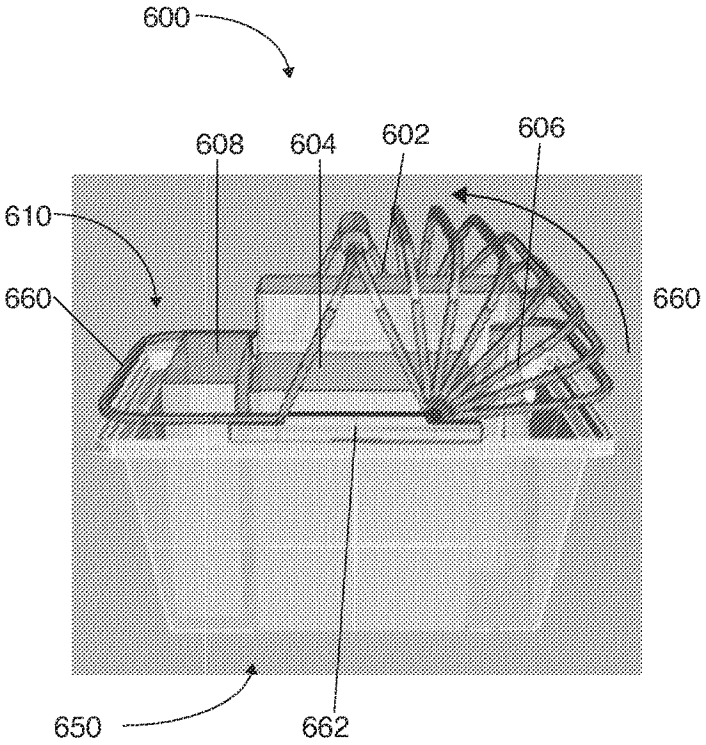
FIGS. 6A and 6B are views of one combination carrying device in accordance with the present disclosure.
Figure 6A:
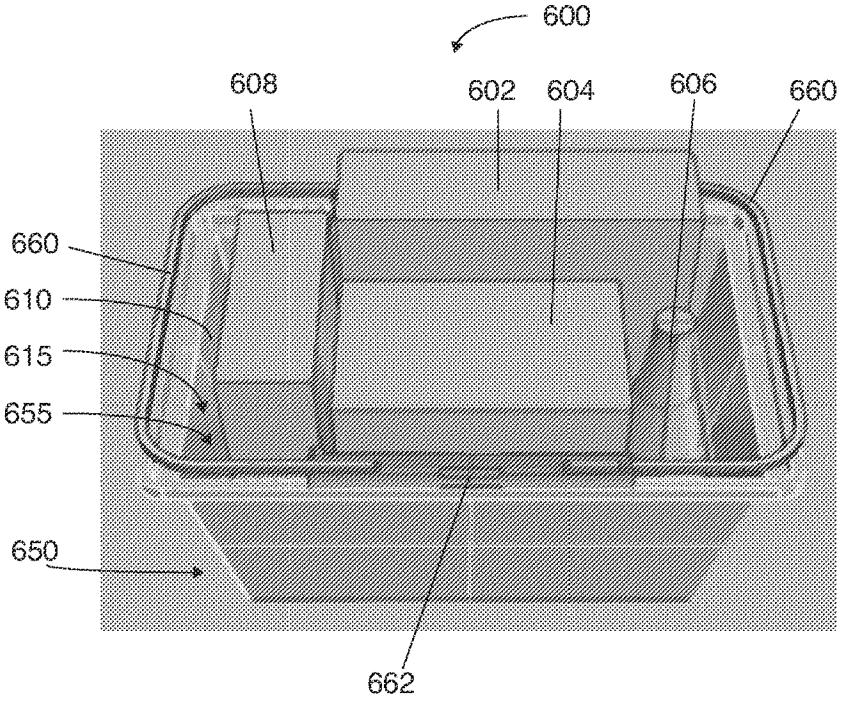

Referring to FIGS. 6A and 6B, views of one combination carrying device 600 in accordance with the present disclosure are shown. Except where otherwise noted, reference numerals preceded by the number "6" shown in FIG. 6A or FIG. 6D indicate components or features that are similar to components or features having reference numerals preceded by the number "5" shown in FIG. 5A, FIG. 5B, FIG. 5C or FIG. 5D, by the number "4" shown in FIG. 4, by the number "3" shown in FIG. 3A or 3B, by the number "2" shown in FIG. 2A or 2B, or by the number "1" shown in FIGS. 1A and 1B.

Referring to FIG. 6A, a top perspective view of the combination carrying device 600 shows a bag 610 and a basket 650. The bag 610 is nested within a volume 655 of the basket 650 and includes a volume 615 having a plurality of items 602, 604, 606, 608 of various sizes disposed therein. As is shown in FIG. 6A, the basket 650 comprises a pair of handles 660 that are mounted to central mounts 662 provided near an upper perimeter of the volume 655, and are rotated downwardly and outwardly, such that the handles 660 rest atop the upper perimeter of the volume 655.

As is discussed above, however, the handles 660 may be rotated upwardly and inwardly, such that the handles 660 meet above the volume 615 of the bag 610, and enable a user to carry the combination carrying device 600 throughout a materials handling facility. Referring to FIG. 6B, a front perspective view of the combination carrying device 600 of FIG. 6A is shown. As is shown in FIG. 6B, the handles 660 are independently and rotatably mounted to an upper perimeter of the volume 655 of the basket 650, such that each of the handles 660 may be rotated between the upper perimeter of the volume 655 and a point above a centroid of the bag 610 and the basket 650, at which a user may collectively grasp the handles 660 in order to transport the combination carrying device 600 throughout a material handling facility or at any other relevant location at which the combination carrying device 600 is provided.

As is further shown in FIG. 6B, the rotatable mounting and alignment of the handles 660 about the upper perimeter of the volume 655 enables the items 602, 604, 606, 608, which are substantially taller than or have dimensions that are greater than any of the sides of the basket 650, to be carried within the combination carrying device 600, as the handles 660 may be rotated above such items 602, 604, 606, 608. The maximum height of an item that may be carried therein may be defined by a sum of a depth of the basket 650 and an interior radial length of the handle 660. For example, where the basket has a depth of approximately twelve inches (12"), and the handle has an interior radial length of approximately eight inches (8"), items having heights of up to approximately twenty inches (20") may be accommodated within the basket in a central region thereof. As is shown in FIG. 6B, the largest of the items 602, 604, 606, 608, viz., item 602, may be positioned substantially centrally within the combination carrying device 600, such that the handles 660 may be rotated from the upper perimeter of the basket 650 upwardly and inwardly to meet above the items 602, 604, 606, 608 with sufficient clearance such that a user may grasp the handles 660 and carry the combination carrying device 600 thereby.

Figure 7B:
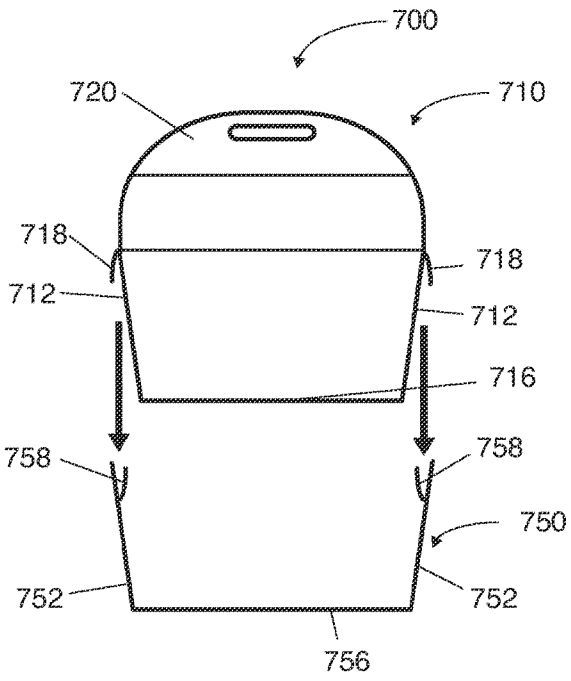
FIGS. 7A and 7B are views of components of one combination carrying device in accordance with implementations of the present disclosure.
Figure 7A:
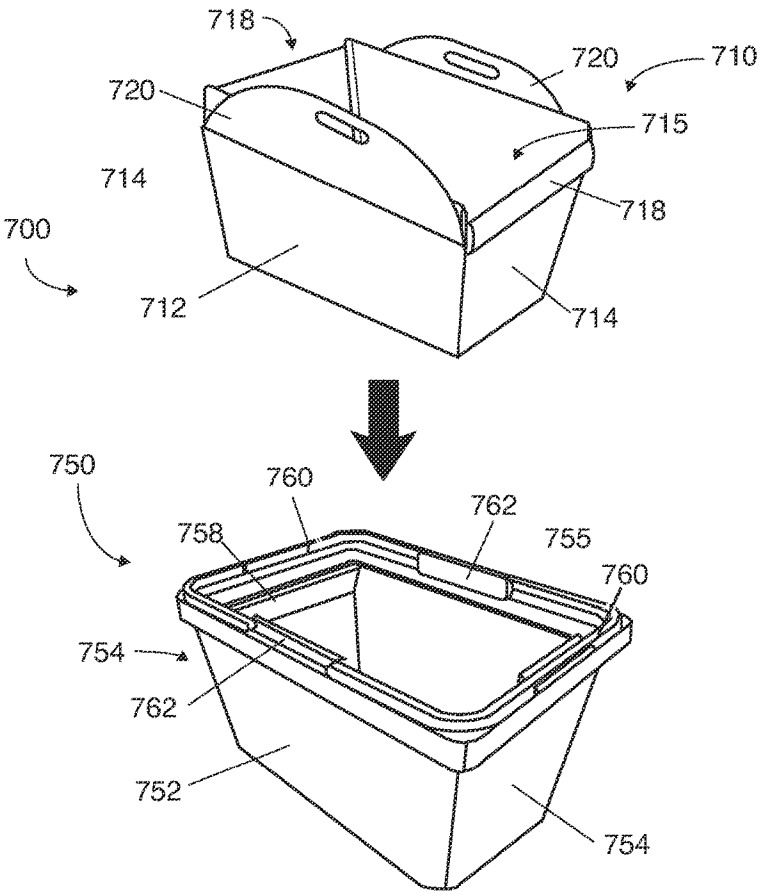

As is also discussed above, the combination carrying devices of the present disclosure may include bags and baskets, as well as one or more features that enable a bag to be nested within a basket, and releasably secured in place until a user elects to extract the bag from the basket. Such baskets may include one or more slits, clips or other features that are provided to mate with a pocket, tab or other feature on a bag in order to releasably maintain the bag within the basket. Referring to FIGS. 7A and 7B, views of one combination carrying device 700 in accordance with the present disclosure are shown. Except where otherwise noted, reference numerals preceded by the number "7" shown in FIG. 7A or FIG. 7B indicate components or features that are similar to components or features having reference numerals preceded by the number "6" shown in FIG. 6A or FIG. 6D, by the number "5" shown in FIG. 5A, FIG. 5B, FIG. 5C or FIG. 5D, by the number "4" shown in FIG. 4, by the number "3" shown in FIG. 3A or 3B, by the number "2" shown in FIG. 2A or 2B, or by the number "1" shown in FIGS. 1A and 1B.

As is shown in FIGS. 7A and 7B, the combination carrying device 700 includes a bag 710 and a basket 750. The bag 710 includes a pair of long sides 712, a pair of short sides 714 and a bottom 716 which define a volume 715 for receiving one or more items therein. Additionally, as is also shown in FIGS. 7A and 7B, the bag 710 includes a pocket 718 provided on each of the short sides 714, along an upper portion of an outer edge. The basket 750 is formed from a pair of long sides 752, a pair of short sides 754 and a bottom 756 which define a volume 755 for receiving the bag 710 therein. As is further shown in FIGS. 7A and 7B, the basket 750 further includes a hook 758 or latch provided on each of the short sides 754, along an upper portion of an inner edge.

In accordance with implementations of the present disclosure, the pockets 718 of the bag 710 and the flat hooks 758 of the basket 750 are provided to mate with one another when the bag 710 is nested within the basket 750, thereby releasably maintaining the bag 710 within the basket 750. The hook 758 and the short side 754 may define a narrow gap into which the pocket 718 may be inserted. According to some implementations of the present disclosure, the hook 758 may be releasably biased into the short side 754, such that a human operator or machine may separate the hook 758 from the short side 754 and open a nominal (e.g., three-sixteenths of an inch) gap therebetween in order to insert at least a portion of the pocket 718 therein. The degree or extent of the bias provided by the hook 758 may be sufficiently high enough to maintain the bag 710 within the basket 750 during normal use of the combination carrying device 700, yet sufficiently low enough to allow the bag 710 to be extracted from the basket 750 by simply raising the bag 710 therefrom by the handles 720.

Maintaining the bag 710 within the basket 750 of the combination carrying device 700 using the hook 758 and the pocket 718 enables the combination carrying device 700 to be stacked in a nested configuration along with other combination carrying devices 700, with bags 710 interleaved with each of the baskets 750. In this regard, a user may retrieve one of the combination carrying devices 700 from the stack upon arriving at a materials handling facility with confidence that the bag 710 will remain within the basket 750 of the combination carrying device 700 that he or she has retrieved. Maintaining the bag 710 within the basket 750 of the combination carrying device 700 also enables a user to transition the items from the basket 710 as a single unit by removing the bag 710 and the contents thereof from the basket 750 by lifting the handles 720. Such a quick transition is beneficial when moving picked items to a packing station, when checking out at a retail establishment and/or at other transition points where a separate step of removing items from a basket and/or bagging of removed items is traditionally required.

Although the combination carrying device 700 of FIGS. 7A and 7B includes the hook 758 and the pocket 718 for releasably maintaining the bag 710 within the basket 750, those of ordinary skill in the pertinent arts will recognize that any type or form of devices or implements may be provided on bags or baskets of the present disclosure for this purpose. For example, a hook and loop fastener including male and female parts may be provided, with one of the male or female parts provided on an underside of the bottom 716 of the bag 710, and the other of the male or female parts provided on an inner surface of the bottom 756 of the basket 750, in an alignment that ensures that the bag 710 remains in releasable contact within the basket 750. The devices or implements for maintaining bags and baskets releasably in contact with one another in combination carrying devices of the present disclosure are not limited.

Figure 8B:
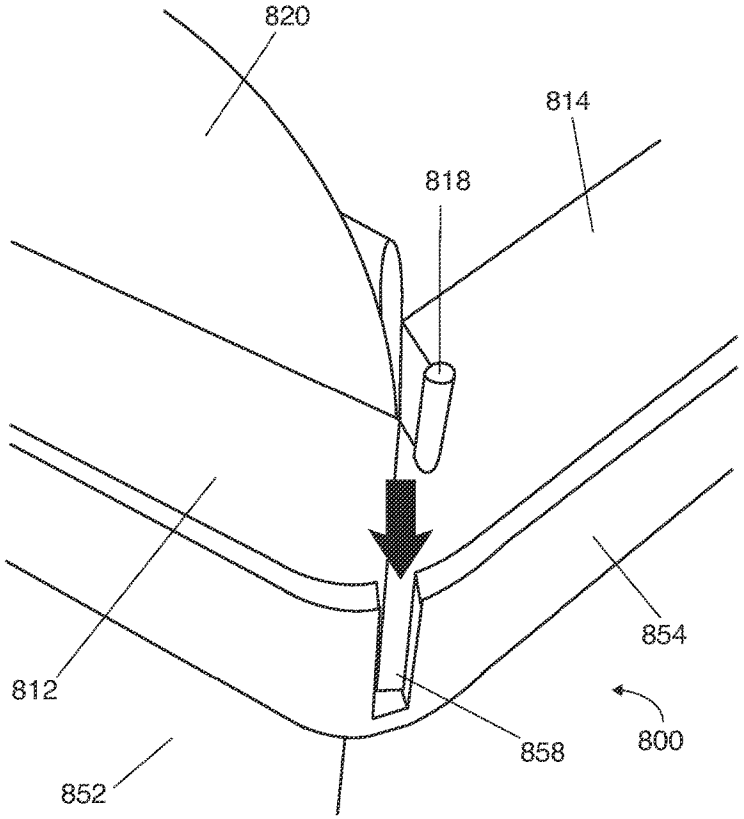
FIGS. 8A and 8B are views of components of one combination carrying device in accordance with implementations of the present disclosure.
Figure 8A:
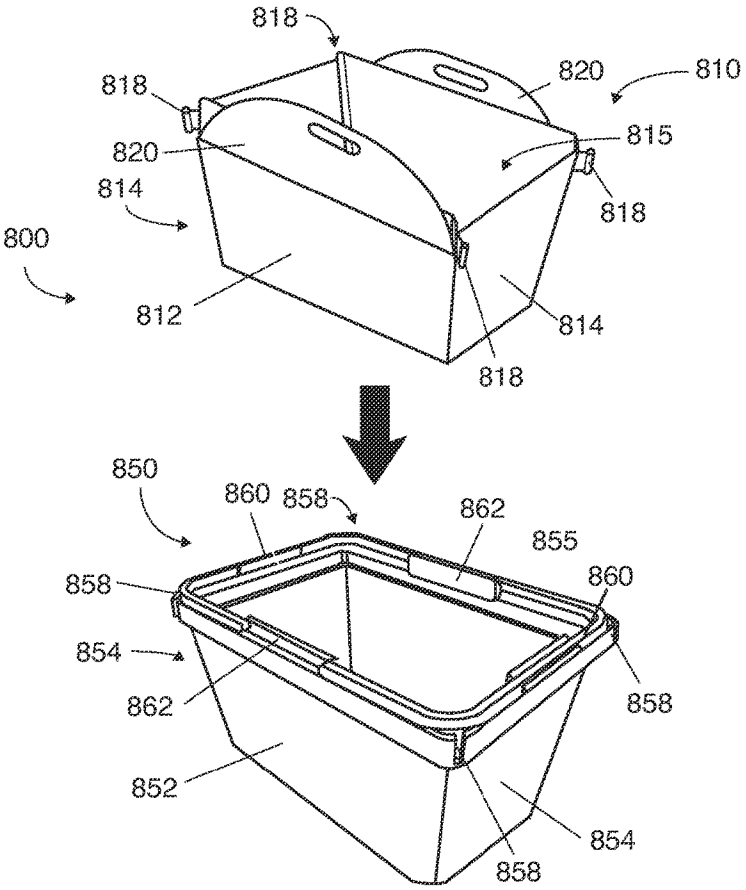

Referring to FIGS. 8A and 8B, views of one combination carrying device 800 in accordance with the present disclosure are shown. Except where otherwise noted, reference numerals preceded by the number "8" shown in FIG. 8A or FIG. 8B indicate components or features that are similar to components or features having reference numerals preceded by the number "7" shown in FIG. 7A or FIG. 7B, by the number "6" shown in FIG. 6A or FIG. 6D, by the number "5" shown in FIG. 5A, FIG. 5B, FIG. 5C or FIG. 5D, by the number "4" shown in FIG. 4, by the number "3" shown in FIG. 3A or 3B, by the number "2" shown in FIG. 2A or 2B, or by the number "1" shown in FIGS. 1A and 1B.

As is shown in FIGS. 8A and 8B, the combination carrying device 800 includes a bag 810 and a basket 850, with the bag 810 including a pair of long sides 812, a pair of short sides 814 and a bottom 816 which define a volume 815 for receiving one or more items therein. Additionally, as is also shown in FIGS. 8A and 8B, the bag 810 includes a plurality of tabs 818 or other extensions provided at each of the corners where one of the long sides 812 meets one of the short sides 814, near an upper perimeter of the volume 815. The tabs 818 may be formed from any material and may be joined at a proximal end to the bag 810 at one of the long sides 812 or one of the short sides 814 thereof, e.g., by stitching, staples or adhesives.

The tabs 818 may include portions of varying thicknesses. For example, in some implementations, the tabs 818 may be formed from straps or other like materials that are folded or creased at a distal end thereof, with the ends of each of the straps joined to either or both of a long side 812 and a short side 814, and the fold or crease of the straps defining a wider terminus at a distal end of the tabs 818. Alternatively, the tabs 818 may include one or more additional folds, creases or knots at distal ends thereof.

As is also shown in FIGS. 8A and 8B, the basket 850 is formed from a pair of long sides 852, a pair of short sides 854 and a bottom 856 which define a volume 855 for receiving the bag 810 therein. The basket 850 further includes slots 858 or other narrow openings provided at each of the corners where one of the long sides 852 meets one of the short sides 854, near an upper perimeter of the volume 855. The slots 858 may be formed within the basket 850 in any manner, e.g., when the basket is formed, or by any punching, drilling, slicing or like manual or automatic processes.

In accordance with some implementations of the present disclosure, the tabs 818 of the bag 810 and the slots 858 of the basket 850 are provided to mate with one another when the bag 810 is nested within the basket 850, thereby releasably maintaining the bag 810 within the basket 850. The dimensions of the slot 858 of the baskets 850 may be selected based on one or more dimensions of the tabs 818 of the bags 810. For example, the slot 858 of a basket 850 may be formed to snugly accommodate the tab 818 of a bag 810, such that friction or biasing forces maintain the tab 818 within the slot 858, and the bag 810 within the basket 850 accordingly. According to some implementations of the present disclosure, the slot 858 and the bag 818 may each have a nominal (e.g., three-sixteenths of an inch) gap thickness. The degree or extent of the friction or bias provided by the slot 858 may be sufficiently high enough to maintain the bag 810 within the basket 850 during normal use of the combination carrying device 800, yet sufficiently low enough to allow the bag 810 to be extracted from the basket 850 by simply raising the bag 810 therefrom by the handles 820.

As with the combination carrying device 700 of FIG. 7, maintaining the bag 810 within the basket 850 of the combination carrying device 800 using the slot 858 and the tab 818 enables the combination carrying device 800 to be stacked in a nested configuration along with other combination carrying devices 800, with bags 810 interleaved with each of the baskets 850. A user may retrieve one of the combination carrying devices 800 from the stack upon arriving at a materials handling facility with confidence that the bag 810 will remain within the basket 850 of the combination carrying device 800 that he or she has retrieved. Maintaining the bag 810 within the basket 850 of the combination carrying device 800 also enables a user to transition the items from the basket 810 as a single unit by removing the bag 810 and the contents thereof from the basket 850 by lifting the handles 820.

Although the disclosure has been described herein using exemplary techniques, components, and/or processes for implementing the systems and methods of the present disclosure, it should be understood by those skilled in the art that other techniques, components, and/or processes or other combinations and sequences of the techniques, components, and/or processes described herein may be used or performed that achieve the same function(s) and/or result(s) described herein and which are included within the scope of the present disclosure. Although some of the implementations of the combination carrying devices disclosed herein include bags and baskets having corresponding frustopyramidal volumes, the present disclosure is not so limited, and bags and baskets having any corresponding shape or volume, e.g., any type or form of polyhedron or other three-dimensional shape. For example, the combination carrying devices of the present disclosure may include bags and baskets having corresponding frustoconical volumes, e.g., hollow cavities having shapes corresponding to a frustrum of a cone, or a conic frustrum, for receiving one or more items therein.

Additionally, the bags of the present disclosure are also not limited for use in connection with non-wheeled baskets, such as those discussed herein. Rather, one or more of the bags disclosed herein may be releasably nested within a wheeled cart or other like apparatus, and may feature a volume that corresponds to a volume of the cart or other apparatus. In this regard, when a user has completed the picking of items into the cart, the user may simply extract the bag from the cart by one or more handles provided thereon.

It should be understood that, unless otherwise explicitly or implicitly indicated herein, any of the features, characteristics, alternatives or modifications described regarding a particular implementation herein may also be applied, used, or incorporated with any other implementation described herein, and that the drawings and detailed description of the present disclosure are intended to cover all modifications, equivalents and alternatives to the various implementations as defined by the appended claims. Moreover, with respect to the one or more methods or processes of the present disclosure described herein, orders in which such methods or processes are presented are not intended to be construed as any limitation on the claimed inventions, and any number of the method or process steps or boxes described herein can be combined in any order and/or in parallel to implement the methods or processes described herein. Also, the drawings herein are not drawn to scale.

Conditional language, such as, among others, "can," "could," "might," or "may," unless specifically stated otherwise, or otherwise understood within the context as used, is generally intended to convey in a permissive manner that certain implementations could include, or have the potential to include, but do not mandate or require, certain features, elements and/or steps. In a similar manner, terms such as "include," "including" and "includes are generally intended to mean "including, but not limited to." Thus, such conditional language is not generally intended to imply that features, elements and/or steps are in any way required for one or more implementations or that one or more implementations necessarily include logic for deciding, with or without user input or prompting, whether these features, elements and/or steps are included or are to be performed in any particular implementation.

Disjunctive language such as the phrase "at least one of X, Y, or Z," or "at least one of X, Y and Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain implementations require at least one of X, at least one of Y, or at least one of Z to each be present.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B and C" can include a first processor configured to carry out recitation A working in conjunction with a second processor configured to carry out recitations B and C.

Language of degree used herein, such as the terms "about," "approximately," "generally," "nearly" or "substantially" as used herein, represent a value, amount, or characteristic close to the stated value, amount, or characteristic that still performs a desired function or achieves a desired result. For example, the terms "about," "approximately," "generally," "nearly" or "substantially" may refer to an amount that is within less than 10% of, within less than 5% of, within less than 1% of, within less than 0.1% of, and within less than 0.01% of the stated amount.

Although the invention has been described and illustrated with respect to illustrative implementations thereof, the foregoing and various other additions and omissions may be made therein and thereto without departing from the spirit and scope of the present disclosure.

What is claimed is:

1. A carrying device comprising:

a bag including:

a first carrying volume defined by a first long side, a second long side, a first short side, a second short side, and a first bottom, wherein the first carrying volume defines a first tapered shape, wherein the first long side, the second long side, the first short side, the second short side, and the first bottom are formed from a laminated fabric material, and wherein the first carrying volume comprises a first opening defined by an upper edge of the first long side, an upper edge of the second long side, an upper edge of the first short side and an upper edge of the second short side;

a first handle extension formed from the laminated fabric material, wherein the first handle extension is joined to the upper edge of the first long side at a first crease, wherein the first handle extension further comprises a second crease aligned parallel to the first crease, wherein the second crease defines a first subsection of the first handle extension and a second subsection of the first handle extension, wherein the first subsection is between the first crease and the second crease, wherein the first handle extension further comprises a first elongated handle opening provided in the second subsection, wherein the first elongated handle opening has an oblong shape that is aligned parallel to the second crease, wherein the first elongated handle opening comprises a first reinforcement about a first perimeter of the first elongated handle opening, and wherein the first elongated handle opening has an oblong shape and is sized to accommodate a plurality of fingers of a human hand; and a second handle extension formed from the laminated fabric material, wherein the second handle extension is joined to the upper edge of the second long side at a third crease, wherein the second handle extension further comprises a third crease aligned parallel to the fourth crease, wherein the fourth crease defines a third subsection of the second handle extension and a fourth subsection of the second handle extension, wherein the third subsection is between the third crease and the fourth crease, wherein the second handle extension further comprises a second elongated handle opening provided in the fourth subsection, wherein the second elongated handle opening has an oblong shape that is aligned parallel to the fourth crease, wherein the second elongated handle opening comprises a second reinforcement about a second perimeter of the second elongated handle opening, and wherein the second elongated handle opening is sized to accommodate a plurality of fingers of a human hand; and a basket including:

a second carrying volume defined by a third long side, a fourth long side, a third short side, a fourth short side, and a second bottom, wherein the second carrying volume defines a second tapered shape corresponding to the first tapered shape, and wherein each of the third long side, the fourth long side, the third short side, the fourth short side and the second bottom is formed from a rigid plastic material, and wherein the second carrying volume comprises a second opening defined by an upper edge of the third long side, an upper edge of the fourth long side, an upper edge of the third short side and an upper edge of the fourth short side; and a first handle and a second handle, wherein each of the first handle and the second handle is rotatably joined to an outer surface of at least one of the third long side or the fourth long side, wherein the bag is releasably maintained within the basket when at least a first portion of the bag is mated with at least a second portion of the basket, wherein the first handle extension is folded away from the first opening about the first crease and toward the first opening about the second crease such that the first subsection is provided between the first long side and the third long side, and at least a portion of the second subsection extends above the first opening and the second opening, and wherein the second handle extension is folded away from the first opening about the third crease and toward the first opening about the fourth crease such that the third subsection is provided between the second long side and the fourth long side, and at least a portion of the fourth subsection extends above the first opening and the second opening.

2. The carrying device of claim 1, wherein the first portion of the bag is at least one pocket provided on an outer surface of at least one of the first short side or the second short side, wherein the second portion of the basket is at least one hook provided on an inner surface of at least one of the third short side or the fourth short side, and wherein the first portion of the bag is mated with the second portion of the basket when at least a portion of the at least one hook is releasably maintained within at least a portion of the at least one pocket.

3. The carrying device of claim 1, wherein the first portion of the bag is at least one tab provided at an intersection of at least one of the first long side or the second long side with at least one of the first short side or the second short side, wherein the second portion of the basket is at least one slot provided at an intersection of at least one of the third long side or the fourth long side with at least one of the third short side or the fourth short side, and wherein the first portion of the bag is mated with the second portion of the basket when at least a portion of the at least one tab is releasably maintained within at least a portion of the at least one slot.

4. The carrying device of claim 1, wherein the first handle extension has a substantially hemispheric shape including an arc and a chord joined to the upper edge of the first long side at the first crease, and wherein a length of the chord of the first handle extension is substantially equal to a length of the first long side at the first crease.

5. The carrying device of claim 1, wherein a first angle defined by the first long side and the first short side is substantially equal to a second angle defined by the third long side and the third short side; and wherein a third angle defined by the second long side and the second short side is substantially equal to a fourth angle defined by the fourth long side and the fourth short side.

6. A flexible item carrier comprising:

a first side panel having a first upper edge and a first lower edge;

a second side panel having a second upper edge and a second lower edge;

a first end panel having a third upper edge and a third lower edge;

a second end panel having a fourth upper edge and a fourth lower edge;

a bottom panel having a first edge, a second edge, a third edge and a fourth edge, wherein the first lower edge is joined to the first edge, wherein the second lower edge is joined to the second edge, wherein the third lower edge is joined to the third edge, and wherein the fourth lower edge is joined to the fourth edge;

a first handle extension joined to the first side panel at a first crease along a length of the first upper edge, wherein the first handle extension comprises a second crease aligned parallel to the first crease; and a second handle extension joined to the second side panel at a third crease along a length of the second upper edge, wherein the second handle extension comprises a fourth crease aligned parallel to the third crease, wherein the first side panel, the second side panel, the first end panel, the second end panel, and the bottom panel define a first frustopyramidal volume having a first opening defined by the first upper edge, the second upper edge, the third upper edge and the fourth upper edge, wherein the first handle extension is folded away from the first opening about the first crease, wherein the first handle extension is folded toward the first opening about the second crease, wherein the second handle extension is folded away from the first opening about the third crease, wherein the second handle extension is folded toward the first opening about the fourth crease, and wherein the flexible item carrier is configured for releasable insertion into at least a portion of a rigid item carrier.

7. The flexible item carrier of claim 6, wherein the first side panel, the second side panel, the first end panel, the second end panel, the bottom panel and each of the handle extensions is formed from a common fabric material.

8. The flexible item carrier of claim 7, wherein at least a portion of the common fabric material comprising an inner surface of the first frustopyramidal volume and at least a portion of the common fabric material comprising an outer surface of the first frustopyramidal volume is laminated.

9. The flexible item carrier of claim 7, wherein the common fabric material is at least one of:

a woven fabric comprising one or more plastic fibers;

a woven fabric comprising one or more cotton fibers;

a woven fabric comprising one or more paper fibers;

at least one leather;

at least one canvas; or a non-woven fabric comprising at least one of polypropylene or polyethylene.

10. The flexible item carrier of claim 7, wherein the first side panel is joined to the first end panel and the second end panel by stitching, and wherein the second side panel is joined to the first end panel and the second end panel by stitching.

11. The flexible item carrier of claim 10, wherein the flexible item carrier is formed from a single sheet of the common flexible material, wherein the single sheet comprises the first side panel, the second side panel, the first end panel, the second end panel, the bottom panel and each of the handle extensions, and wherein the first lower edge is joined to the first edge, the second lower edge is joined to the second edge, the third lower edge is joined to the third edge and the fourth lower edge is joined to the fourth edge as a result of being formed from the single sheet of the common flexible material.

12. The flexible item carrier of claim 6, wherein the first side panel and the second side panel have a first trapezoidal area, wherein the first end panel and the second end panel have a second trapezoidal area, and wherein the first trapezoidal area is greater than the second trapezoidal area.

13. The flexible item carrier of claim 6, wherein each of the handle extensions comprises a handle panel having at least one opening adapted to receive at least one hand therein, and wherein each of the handle panels comprises reinforcement stitching provided about a perimeter of the at least one opening.

14. The flexible item carrier of claim 13, wherein a shape of one of the handle panels is one of:

a trapezoid defining at least one base, wherein the at least one base of the trapezoid is joined to the length of the first upper edge at the first crease;

a circular sector defining an arc and a chord, wherein the chord of the circular sector is joined to the length of the first upper edge at the first crease;

an elliptical sector defining an arc and at least one line segment, wherein the at least one line segment of the elliptical sector is joined to the length of the first upper edge at the first crease; or a parabolic sector defining an arc and a chord, wherein the chord of the parabolic sector is joined to the length of the first upper edge at the first crease.

15. The flexible item carrier of claim 6, wherein the first handle extension comprises a first long handle strap and a first short handle strap, wherein the second handle extension comprises a second long handle strap and a second short handle strap, wherein a length of the first long handle strap is substantially equal to a length of the second long handle strap, and wherein a length of the first short handle strap is substantially equal to a length of the second short handle strap.

16. The flexible item carrier of claim 6, wherein at least one of a shape or a size of the first frustopyramidal volume corresponds to at least one of a shape or a size of a second frustopyramidal volume of the rigid item carrier.

17. The flexible item carrier of claim 16, wherein the second crease is configured for insertion between an outer surface of the first side panel and an inner surface of a side panel of the rigid item carrier, and wherein the second frustopyramidal volume is defined at least in part by the side panel of the rigid item carrier.

18. The flexible item carrier of claim 16, further comprising at least one pocket on an outer surface of the first end panel, wherein the at least one pocket is configured to receive at least a portion of at least one hook provided on an inner surface of the rigid item carrier.

19. The flexible item carrier of claim 16, further comprising at least one stitched tab on an outer corner defined by the first side panel and the first end panel, wherein the at least one stitched tab is configured to be inserted into at least one slot provided on an inner corner of the rigid item carrier.

20. A combination carrying device comprising a rigid item carrier and a flexible item carrier, wherein the rigid item carrier comprises:

a first frustopyramidal cavity defining an open end having an upper perimeter and a closed end;

a first handle rotatably mounted at a first point about the upper perimeter of the first frustopyramidal cavity;

a second handle rotatably mounted at a second point about the upper perimeter of the first frustopyramidal cavity; and a flexible item carrier releasably nested within the rigid item carrier, wherein the rigid item carrier is formed from an injection-molded plastic, wherein at least one of a size or a shape of the first frustopyramidal cavity corresponds to at least one of a size or a shape of a second frustopyramidal cavity of the flexible item carrier, and wherein the flexible item carrier comprises:

a first side panel having a first upper edge and a first lower edge;

a second side panel having a second upper edge and a second lower edge;

a first end panel having a third upper edge and a third lower edge;

a second end panel having a fourth upper edge and a fourth lower edge;

a bottom panel having a first edge, a second edge, a third edge and a fourth edge, wherein the first lower edge is joined to the first edge, wherein the second lower edge is joined to the second edge, wherein the third lower edge is joined to the third edge, and wherein the fourth lower edge is joined to the fourth edge;

a first handle extension joined to the first side panel at a first crease along a length of the first upper edge, wherein the first handle extension comprises a second crease aligned parallel to the first crease, wherein the first handle extension is folded away from the second frustopyramidal cavity about the first crease, wherein the first handle extension is folded toward the second frustopyramidal cavity about the second crease, wherein the first handle extension further comprises a first elongated handle opening having an oblong shape that is aligned substantially parallel to the second crease, wherein the first elongated handle opening comprises a first reinforcement about a first perimeter of the first elongated handle opening, and wherein the first elongated handle opening is sized to accommodate a plurality of fingers of a human hand; and a second handle extension joined to the second side panel at a third crease along a length of the second upper edge, wherein the second handle extension comprises a fourth crease aligned parallel to the third crease, wherein the second handle extension is folded away from the second frustopyramidal cavity about the third crease, wherein the second handle extension is folded toward the second frustopyramidal cavity about the fourth crease, wherein the second handle extension further comprises a second elongated handle opening having an oblong shape that is aligned substantially parallel to the fourth crease, wherein the second elongated handle opening comprises a second reinforcement about a second perimeter of the second elongated handle opening, and wherein the second elongated handle opening is sized to accommodate a plurality of fingers of a human hand, wherein the first side panel, the second side panel, the first end panel, the second end panel, and the bottom panel define the second frustopyramidal cavity, and wherein the rigid item carrier is configured to releasably receive at least a portion of the flexible item carrier folded therein between an inner surface of the first frustopyramidal cavity and an outer surface of the second frustopyramidal cavity.

21. The combination carrying device of claim 20, wherein the first frustopyramidal cavity comprises a first trapezoidal side, a second trapezoidal side, a third trapezoidal side, a fourth trapezoidal side and a bottom panel, and wherein the upper perimeter is defined by a first upper edge of the first trapezoidal side, a second upper edge of the second trapezoidal side, a third upper edge of the third trapezoidal side and a fourth upper edge of the fourth trapezoidal side, and wherein the closed end is defined by the bottom panel.

22. The combination carrying device of claim 20, further comprising a hook provided on an inner surface of the first frustopyramidal cavity, wherein the portion of the flexible item carrier comprises a pocket, and wherein the rigid item carrier is configured to receive at least the pocket of the flexible item carrier between the hook and the inner surface.

23. The combination carrying device of claim 20, further comprising at least one slot provided on at least one corner of the first frustopyramidal cavity at the upper perimeter, wherein the portion of the flexible item carrier comprises a stitched tab, and wherein the at least one slot is configured to receive at least the stitched tab of the flexible item carrier within the at least one slot.

* * * * *